US007762358B2

(12) United States Patent
Saf

(10) Patent No.: US 7,762,358 B2
(45) Date of Patent: Jul. 27, 2010

(54) SENSOR ASSEMBLY IN A GEARBOX FOR POSITIONING

(75) Inventor: Fredrik Saf, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 393 days.

(21) Appl. No.: 11/795,832

(22) PCT Filed: Mar. 8, 2006

(86) PCT No.: PCT/SE2006/000298

§ 371 (c)(1),
(2), (4) Date: Jul. 23, 2007

(87) PCT Pub. No.: WO2006/096121

PCT Pub. Date: Sep. 14, 2006

(65) Prior Publication Data

US 2008/0135303 A1 Jun. 12, 2008

(30) Foreign Application Priority Data

Mar. 11, 2005 (SE) ..... 0500559

(51) Int. Cl.
*E21B 15/00* (2006.01)
*G05B 19/404* (2006.01)

(52) U.S. Cl. ..... 175/170; 74/325; 475/158

(58) Field of Classification Search ..... 175/170; 475/158; 74/325
See application file for complete search history.

(56) References Cited

U.S. PATENT DOCUMENTS 6,310,455 B1 * 10/2001 Siraky et al. ..... 318/560
2005/0274548 A1 * 12/2005 Albert et al. ..... 175/61

FOREIGN PATENT DOCUMENTS

| | | |
|---|---|---|
| DE | 201510 | 7/1983 |
| DE | 19849997 | 5/2000 |
| WO | 0034617 | 6/2000 |

* cited by examiner

*Primary Examiner*—William P Neuder
(74) *Attorney, Agent, or Firm*—Mark P. Stone

(57) ABSTRACT

The invention relates to a sensor assembly in a gearbox which is used for positioning, where the sensor assembly comprises a relative to the gearbox housing (18) fixed sensor (20), and where the angle between the gearbox housing (18) and the output shaft (26) of a gearbox (14, 16) is measured using a to the output shaft (26) fixed and to the sensor (20) connected shaft (28), whereby a sensor assembly which measures the angle in the gearbox (14, 16) including the play in the gearbox (14, 16) is attained, which gives increased precision at the same time as gearboxes (14, 16) with play can be utilized for accurate angle positioning.

17 Claims, 2 Drawing Sheets

SENSOR ASSEMBLY IN A GEARBOX FOR POSITIONING

TECHNICAL FIELD

The present invention relates to a sensor assembly in a gearbox.

BACKGROUND

On modern rock drilling rigs, the positions of the drill booms are measured in order to be able to drill the holes in the correct place in the rock, possibly by using automatic controls. When measuring a position for a drill hole, the angles are measured at each joint of the drill booms and any telescopic movements of these. A boom has normally five to six joints, for which reason the measuring must be carried out with a high degree of precision in order to be able to calculate where the hole will be drilled.

In those instances where gearboxes are used in order to achieve the rotations in the joints of the drill booms, normally the angle in the gearbox is measured by measuring on the input motor shaft, whereby one multiplies with the gear ratio of the gearbox.

The problem with using a sensor assembly which measures the angle in the gearbox by measuring on the input motor shaft of the gearbox is that one does not measure the play which exists in nearly all gearboxes, which means that one, in applications that require a high precision, must use gearboxes which do not have any play, which results in use of expensive gearboxes as standard gearboxes have a play of the order of 0.3 degrees, which cannot be accepted when positioning.

BRIEF DESCRIPTION OF THE INVENTION

The problem that one by measuring on the input motor shaft of the gearbox does not measure the play that exists in nearly all gearboxes, is solved according to the invention by arranging a sensor assembly in a gearbox which is used for positioning, where the sensor assembly comprises a relative to the gearbox housing fixed sensor, and where the angle between the gearbox housing and the output shaft of the gearbox is measured using a shaft fixed to the output shaft fixed and connected to the sensor.

By that the sensor assembly comprises the characteristics in claim 1, the advantage of bringing about a sensor assembly which measures the angle in the gearbox including the play of the gearbox, which gives increased precision at the same time as inexpensive gearboxes with play can be utilized for measuring a position for a drill hole, is attained. Further, a robust assembly is attained as no measuring wheels or separate measuring teeth are needed on the outside of the gearbox.

BRIEF DESCRIPTION OF THE DRAWINGS

The invention will be described below in greater detail with reference to the attached drawings, in which.

DESCRIPTION OF PREFERRED EMBODIMENTS

Figure 1:
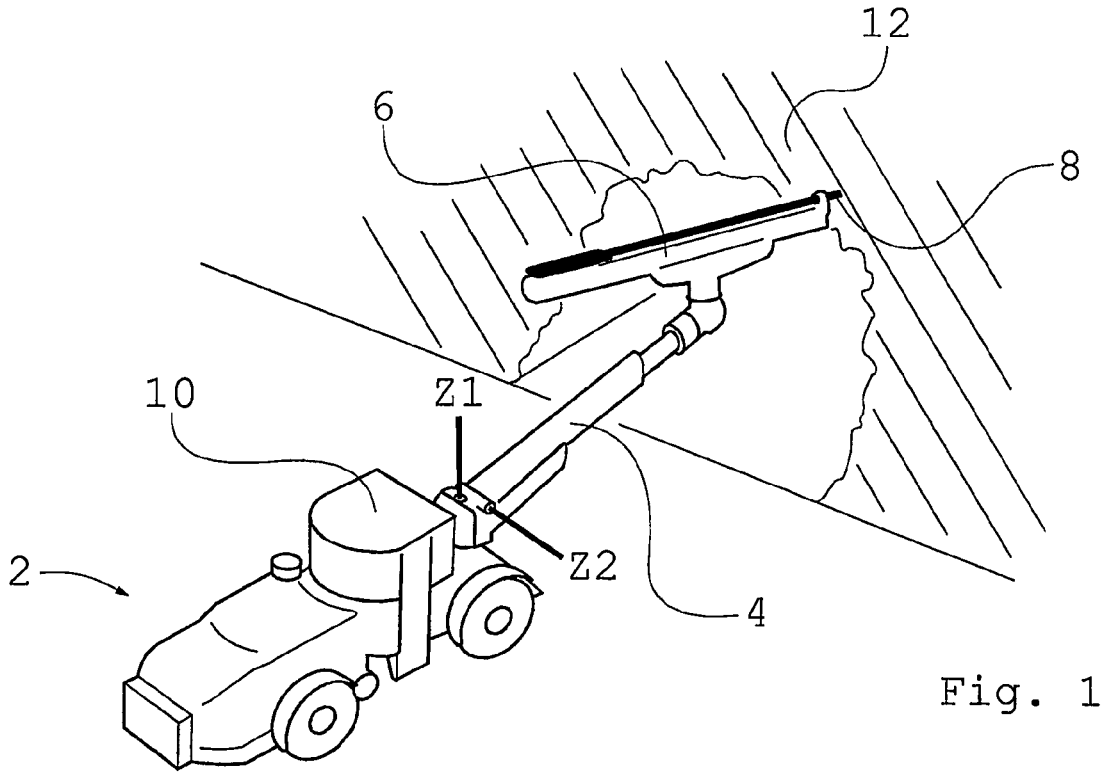
FIG. 1 shows schematically a view of a rock drilling rig.

FIG. 1 shows schematically a view of a rock drilling rig 2, comprising a drill boom 4, a feeder 6 and a cutter head 8. The rock drilling rig 2 can be remotely controlled by an operator via a cable (not shown) or by wireless means, but can also be controlled by an operator located in a cab 10 on the rock drilling rig 2. The operator can control the rock drilling rig 2 either manually, automatically or semi-automatically. When the operator wants to drill a hole in rock 12 using the rock drilling rig 2, it is important to be able to position the cutter head 8, that is the feeder 6, in the correct position and at a correct angular direction in relation to the rock 12 in order to create a required hole, in particular when several holes are to be drilled into the rock 12 parallel to each other, as takes place, for example, when drilling a tunnel through a mountain.

Figure 2:
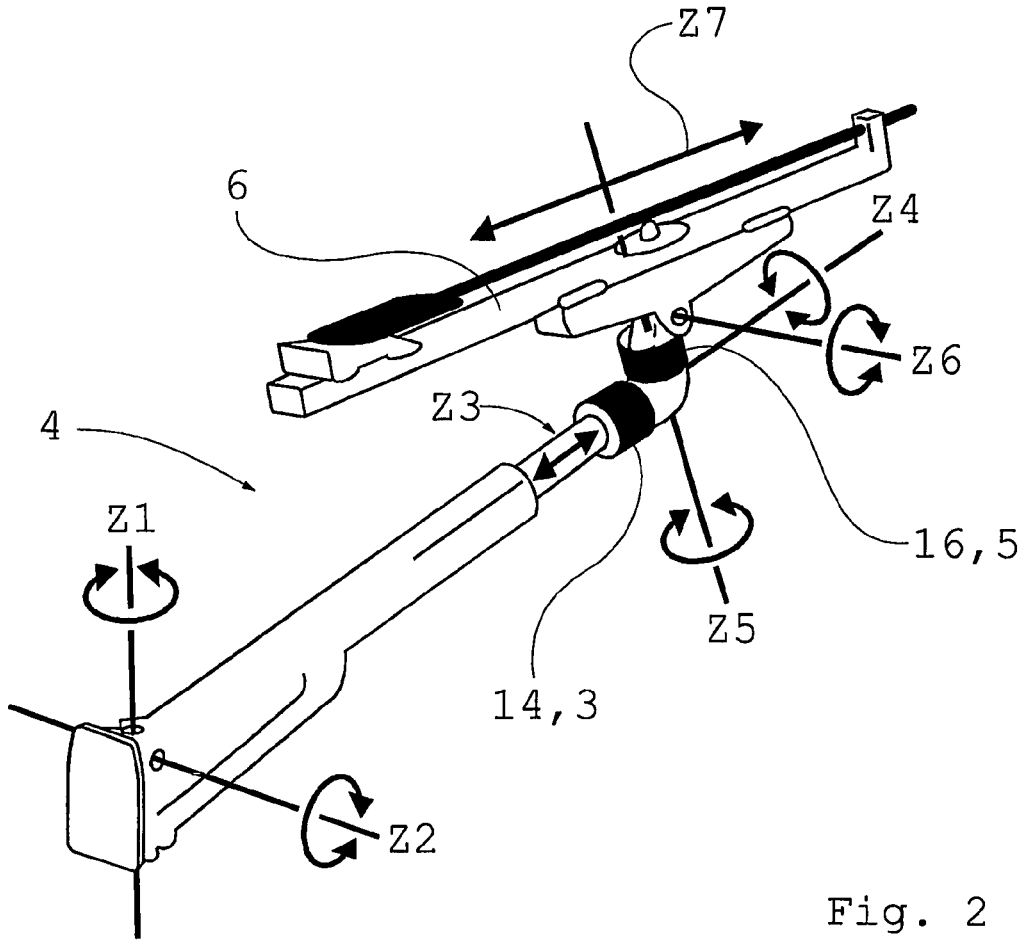
FIG. 2 shows schematically a view of a drill boom on a rock drilling rig according to FIG. 1.

FIG. 2 shows schematically a view of drill boom 4 on a rock drilling rig 2 according to FIG. 1. According to this embodiment, the drill boom 4 has five rotational degrees of freedom Z1, Z2, Z4, Z5, Z6, a telescopic degree of freedom Z3 at the telescopic part of the drill boom 4, and an additional telescopic degree of freedom Z7 in the form of feed movement and feed for the movable feeder 6. When measuring a position for a drill hole, on one hand the angles are measured at each joint of a drill boom 4 that has a rotational degree of freedom Z1, Z2, Z4, Z5, Z6, that is at each joint where rotation is possible and, on the other hand, any telescopic movements of the drill boom 4 are measured, that is any telescopic movements at the places on the drill boom 4 that have telescopic degrees of freedom Z3, Z7. In this embodiment gearboxes 14, 16 are used to achieve the rotations in two of the joints 3, 5 of the drill boom 4, that is to adjust the angle of two rotational degrees of freedom Z4, Z5 of the drill boom 4.

Figure 3:
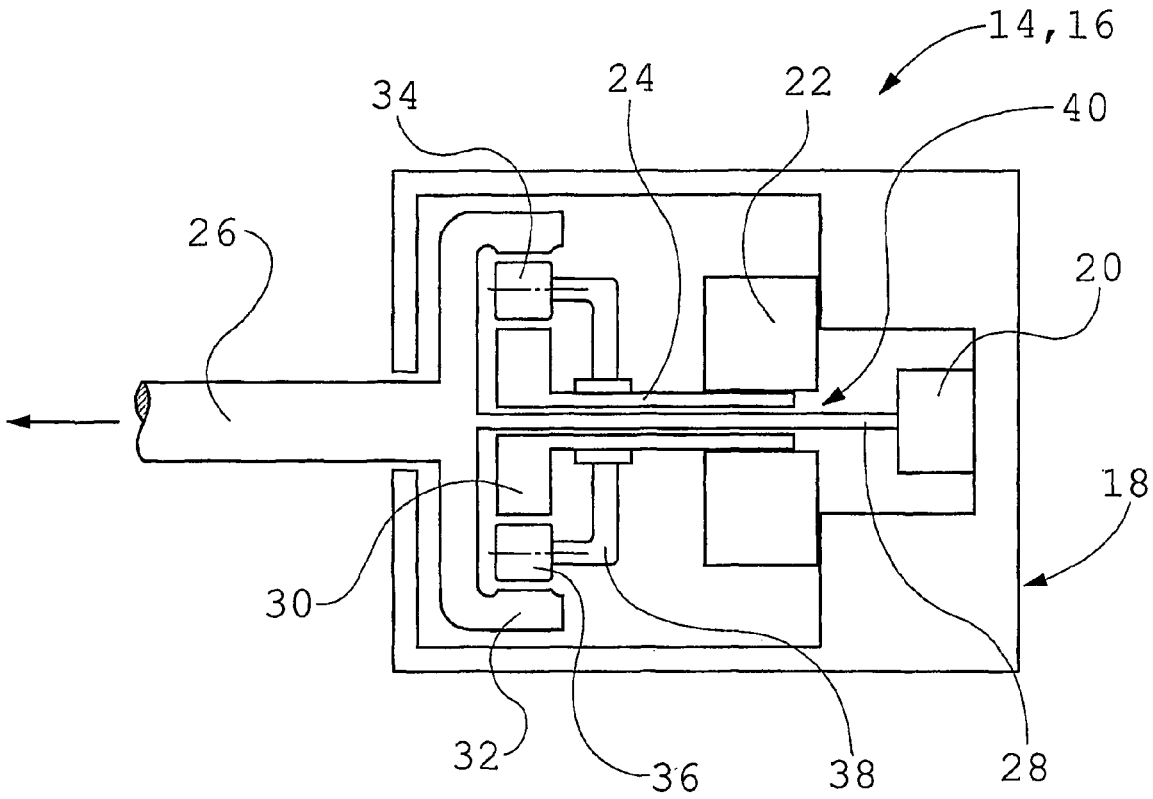
FIG. 3 shows schematically a first embodiment of a sensor assembly according to the invention.

FIG. 3 shows schematically a first embodiment of a sensor assembly according to the invention. The sensor assembly comprises a relative to a gearbox housing 18 fixed sensor 20, a propulsion motor 22, an input shaft 24 of the gearbox 14, 16, an output shaft 26 of the gearbox 14, 16, a to the output shaft 26 fixed shaft 28 which passes through the center of the gearbox 14, 16. In this embodiment the gearbox 14, 16 houses a planetary gear in which inner sun wheel 30, outer sun wheel 32, planet pinions 34, 36 and planet pinion carrier 38 are shown in the figure. The shaft 28 which passes through the center of the gearbox 14, 16 can be fixed to the output shaft 26 by gluing, welding, or by mechanical fixing such as for example by use of splines, or in a similar way. Alternatively, the shaft 28 which passes through the center of the gearbox 14, 16 may be fixed to the output shaft 26 by that they are made in one piece. In this embodiment the propulsion motor 22 is a hollow piston engine with a central through hole 40 through which the shaft 28 which passes through the center of the gearbox 14, 16 may pass. As can be seen in the figure, the shaft 28 also passes through the input shaft 24 of the gearbox 14, 16. By using a compact piston engine, sideways protrusion of the propulsion motor 22 is avoided, which is an advantage when the propulsion motor 22 is to be mounted on a drill boom 4. By using gearboxes 14, 16 of the type mentioned above, in order to achieve the rotations in two of the joints of the drill boom 4, that is gearboxes 14, 16 where the angle between the gearbox housing 18 and the output shaft 26 of the gearbox 14, 16 is measured using a to the output shaft 26 fixed shaft 28 which passes through the center of the gearbox 14, 16, a sensor assembly which measures the angle in the gearbox 14, 16 including the play of the gearbox 14, 16 is achieved, which gives high precision in these joints when positioning the drill boom 4.

Figure 4:
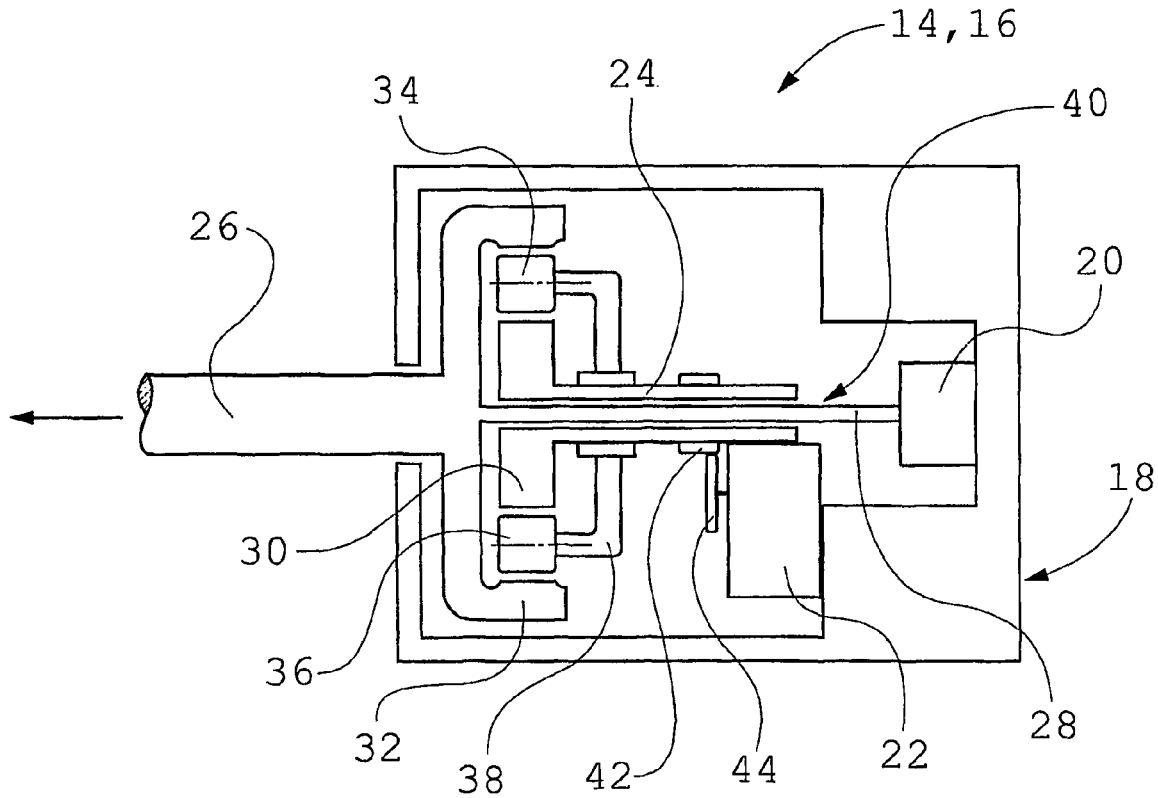
FIG. 4 shows schematically a second embodiment of a sensor assembly according to the invention.

FIG. 4 shows schematically a second embodiment of a sensor assembly according to the invention. This embodiment differs from that described in FIG. 3 only by that the propulsion motor 22 is arranged displaced from the center of the input shaft 24 of the gearbox 14, 16, whereby two toothed wheels 42, 44 are arranged to transfer the torque from the propulsion motor 22 to the input shaft 24 of the gearbox 14, 16.

The invention thus relates to a sensor assembly in a gearbox which is used for positioning, where the sensor assembly comprises a relative to the gearbox housing 18 fixed sensor 20, and where the angle between the gearbox housing 18 and the output shaft 26 of the gearbox 14, 16 is measured using a shaft 28 fixed to the output shaft 26 and connected to the sensor 20.

When positioning using a gearbox it is important to have end positions for the rotation so that one does not damage hoses etc. This can be done using mechanical stop devices but the disadvantage is that these must be strong in order to absorb the rotational force, and at rotations>360 degrees it is difficult in practice to make room for sufficient end position stop devices. By using a sensor assembly according to the invention the angle in the gearboxes that are arranged on the drill boom are measured. Hereby one can provide a control system which receives information about the actual angle and cuts down the power of the motor of the gearbox when approaching a pre-programmed end position. By cutting down the motor power in steps near the end positions, a soft stop is obtained which decreases the stresses on the drill boom. It is also easy to make the end position adjustable if one for example wishes to be able to set a small allowed angle for the rotation of the drill boom so that the drill boom will not be able to collide with for example rock surfaces situated on a side of the rock drilling rig or with the rock drilling rig itself, which gives increased safety. This is an inexpensive way to create end positions as the angle already is measured for the positioning. Thus, the sensor assembly comprises a control system which receives information about the actual angle in a gearbox 14, 16 and cuts down the power to the motor 22 of the gearbox 14, 16 when the gearbox 14, 16 approaches a pre-programmed end position.

The sensor assembly according to the invention is illustrated a being arranged in a gearbox in a drill boom on a rock drilling rig, but can also be used in other types of mining or construction machines where a similarly accurate movement is required. The angle sensor, that is the sensor, is preferably a single-revolution sensor in the embodiments described as a rotation of more than one revolution could cause breakage on hoses and the like, but the angle sensor may of course be arranged as a multi-revolution sensor in applications where this is desirable.

The invention claimed is:

1. Sensor assembly in a gearbox which is used for positioning, where the sensor assembly comprises a sensor (20) fixed relative to a gearbox housing (18), characterized in, that the angle between the gearbox housing (18) and an output shaft (26) of the gearbox (14, 16) is measured using a shaft (28) fixed to the output shaft (26) and connected to the sensor (20), and that the sensor assembly comprises a control system which receives information about the actual angle between the gearbox (14, 16) and the output shaft (26) and reduces the power to a motor (22) of the gearbox (14, 16) when the gearbox (14, 16) approaches a pre-programmed end position.

2. Sensor assembly as claimed in claim 1, characterised in, that the shaft (28) fixed to the output shaft (26) and connected to the sensor (20) passes through a central through hole (40) in the motor (22) connected to an input shaft (24) of the gearbox (14, 16).

3. Sensor assembly as claimed in claim 2, characterised in, that the gearbox (14, 16) is arranged in a mining or construction machine.

4. Sensor assembly as claimed in claim 2, characterised in, that the gearbox (14, 16) is arranged to achieve the rotations for a rotational degree of freedom (Z4, Z5) in a joint (3, 5) of a drill boom (4) in a rock drilling rig (2).

5. Sensor assembly as claimed in claim 1, characterised in, that the gearbox (14, 16) is arranged in a mining or construction machine.

6. Sensor assembly as claimed in claim 1, characterised in, that the gearbox (14, 16) is arranged to achieve the rotations for a rotational degree of freedom (Z4, Z5) in a joint (3, 5) of a drill boom (4) in a rock drilling rig (2).

7. Sensor assembly as claimed in claim 1, characterised in, that the output shaft (26) and the shaft (28) fixed to the output shaft (26) and connected to the sensor (20) are made in one piece.

8. Sensor assembly in a gearbox which is used for positioning, where the sensor assembly comprises a sensor (20) fixed relative to a gearbox housing (18), characterized in, that the angle between the gearbox housing (18) and an output shaft (26) of the gearbox (14, 16) is measured using a shaft (28) fixed to the output shaft (26) and connected to the sensor (20), characterized in, that the shaft (28) fixed to the output shaft (26) and connected to the sensor (20) passes through the center of the gearbox (14, 16), and that the sensor assembly comprises a control system which receives information about the actual angle between the gearbox (14, 16) and the output shaft (26) and reduces the power to a motor (22) of the gearbox (14, 16) when the gearbox (14, 16) approaches a pre-programmed end position.

9. Sensor assembly as claimed in claim 8, characterised in, that the gearbox (14, 16) houses a planetary gear.

10. Sensor assembly as claimed in claim 9, characterised in, that the shaft (28) fixed to the output shaft (26) and connected to the sensor (20) passes through a central through hole (40) in the motor (22) connected to an input shaft (24) of the gearbox (14, 16).

11. Sensor assembly as claimed in claim 9, characterised in, that the gearbox (14, 16) is arranged in a mining or construction machine.

12. Sensor assembly as claimed in claim 9, characterised in, that the gearbox (14, 16) is arranged to achieve the rotations for rotational degree of freedom (Z4, Z5) in a joint (3, 5) of a drill boom (4) in a rock drilling rig (2).

13. Sensor assembly as claimed in claim 9, characterised in, that the output shaft (26) and the shaft (28) fixed to the output shaft (26) and connected to the sensor (20) are made in one piece.

14. Sensor assembly as claimed in claim 2, characterised in, that the shaft (28) fixed to the output shaft (26) and connected to the sensor (20) passes through a central through hole (40) in the motor (22) connected to an input shaft (24) of the gearbox (14, 16).

15. Sensor assembly as claimed in claim 8, characterised in, that the gearbox (14, 16) is arranged in a mining or construction machine.

16. Sensor assembly as claimed in claim 8, characterised in, that the gearbox (14, 16) is arranged to achieve the rotations for a rotational degree of freedom (Z4, Z5) in a joint (3, 5) of a drill boom (4) in a rock drilling rig (2).

17. Sensor assembly as claimed in claim 8, characterised in, that the output shaft (26) and the shaft (28) fixed to the output shaft (26) and connected to the sensor (20) are made in one piece.

* * * * *

UNITED STATES PATENT AND TRADEMARK OFFICE

CERTIFICATE OF CORRECTION

PATENT NO. : 7,762,358 B2
APPLICATION NO. : 11/795832
DATED : July 27, 2010
INVENTOR(S) : Fredrik Saf It is certified that error appears in the above-identified patent and that said Letters Patent is hereby corrected as shown below:

Column 4, Line 47 (Claim 14, Line 1): Delete "claim 2" and substitute --claim 8--.

Signed and Sealed this

Fourteenth Day of September, 2010

David J. Kappos

David J. Kappos
*Director of the United States Patent and Trademark Office*